US008517756B2

(12) United States Patent
Song et al.

(10) Patent No.: US 8,517,756 B2
(45) Date of Patent: Aug. 27, 2013

(54) ELECTRICAL CONNECTOR ASSEMBLY

(75) Inventors: Yong-Jun Song, Shenzhen (CN); Yong-Zhao Huang, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 78 days.

(21) Appl. No.: 13/211,296

(22) Filed: Aug. 16, 2011

(65) Prior Publication Data

US 2013/0023144 A1 Jan. 24, 2013

(30) Foreign Application Priority Data

Jul. 19, 2011 (CN) ..... 2011 1 0202232

(51) Int. Cl.
*H01R 13/627* (2006.01)

(52) U.S. Cl.
USPC ..... 439/357; 439/680

(58) Field of Classification Search
USPC ..... 439/350, 357, 680; 385/60
See application file for complete search history.

(56) References Cited

U.S. PATENT DOCUMENTS

| | | | | |
|---|---|---|---|---|
| 2,891,103 | A * | 6/1959 | Swengel | 439/350 |
| 5,109,452 | A * | 4/1992 | Selvin et al. | 385/69 |
| 5,326,279 | A * | 7/1994 | Sumida | 439/540.1 |
| 5,338,219 | A * | 8/1994 | Hiramoto et al. | 439/350 |
| 6,171,130 | B1 * | 1/2001 | Yoshida et al. | 439/352 |
| 6,536,954 | B2 * | 3/2003 | Asada | 385/60 |

* cited by examiner

*Primary Examiner* — Hien Vu
(74) *Attorney, Agent, or Firm* — Altis Law Group, Inc.

(57) ABSTRACT

An electrical connector assembly includes a male connector and a female connector connectable to the male connector. The male connector includes a male insulating housing and a number of first terminals assembled in the male insulating housing. a protrusion extends up from the top surface of the male insulating housing. The protrusion forms an ejecting surface at a rear side of the protrusion. The female connector includes a female insulating housing and a number of second terminals assembled to the female insulating housing for connecting with the first terminals. a fastening hole is defined in the top surface of the female insulating housing to hold the protrusion therein. The ejecting surface of the protrusion of the male connector is substantially arc-shaped or inclined.

10 Claims, 4 Drawing Sheets

ELECTRICAL CONNECTOR ASSEMBLY

CROSS-REFERENCE TO RELATED APPLICATION

Relevant subject matter is disclosed in a pending U.S. patent application, titled "ELECTRICAL CONNECTOR ASSEMBLY", filed on Aug. 11, 2011, With the application Ser. No. 13/207468, which is assigned to the same assignee as this patent application.

BACKGROUND

1. Technical Field

The present disclosure relates to an electrical connector assembly.

2. Description of Related Art

An electrical connector assembly generally includes a male connector and a female connector connectable to the male connector. For the male connector with a rectangular connection portion and the female connector defining a rectangular recess to hold the connection portion, a great force is needed to insert the male connector into the female connector or disassemble the male connector from the female connector. The amount of force used by a person cannot be accurately controlled and may easily be too great and damage the connectors.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
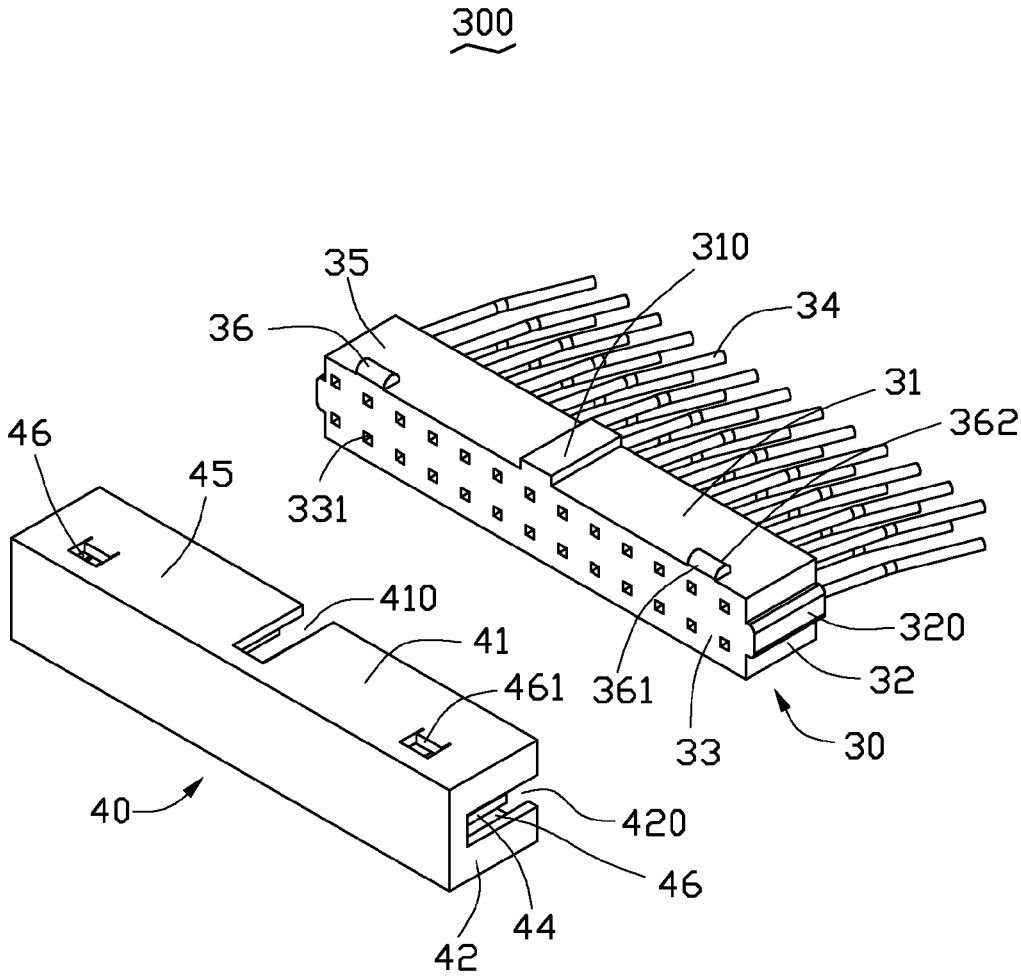
FIG. 1 is an exploded, isometric view of an exemplary embodiment of an electrical connector assembly, wherein the electrical connector assembly includes a male connector.
Figure 2:
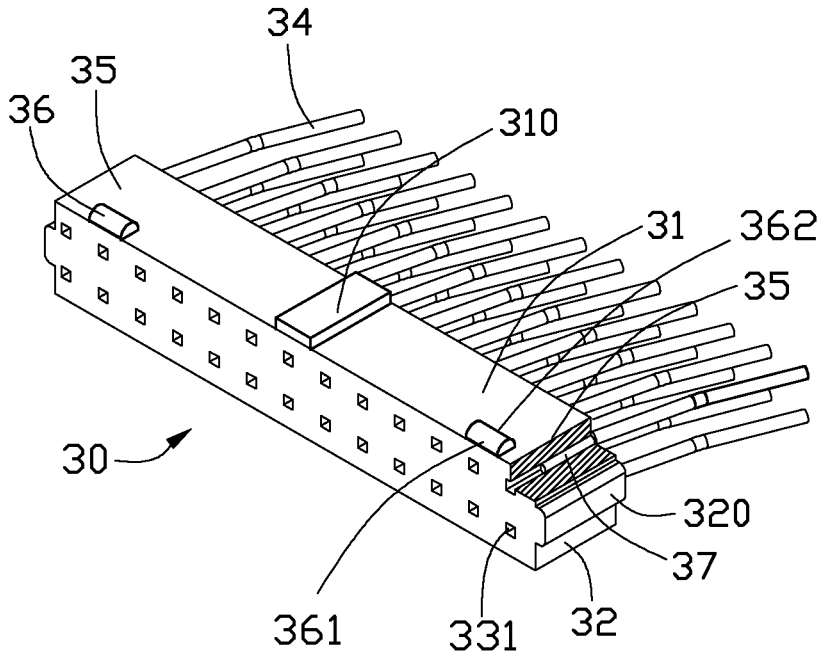
FIG. 2 is a cutaway view of the male connector of FIG. 1.

Referring to FIG. 1 and FIG. 2, an exemplary embodiment of an electrical connector assembly 300 includes a male connector 30 and a female connector 40 connectable with the male connector 30.

The male connector 30 includes a rectangular insulating housing 35 and a plurality of cables 34. The housing 35 defines a plurality of slots 331 extending through a front surface 33 to a back surface opposite to the front surface 33. A plurality of terminals 37 is embedded in the slots 331 and connected to the cables 34. An anti-mistake insertion tab 310 protrudes from a middle top 31 of the insulating housing 35. Two substantially semi-cylindrical protrusions 36 protrude from the top 31 of the housing 35, at two sides of the middle of the insulating housing 35. Each protrusion 36 includes an arc-shaped insertion surface 361 at a front surface of the protrusion 36, and an arc-shaped ejecting surface 362 at a rear surface of the protrusion 36 opposite to the insertion surface 361. Two blocks 320 protrude from left and right end surfaces 32 of the insulating housing 35, respectively. In another embodiment, the protrusions 36 can be triangular, and the insertion surface 361 and the ejecting surface 362 can be inclined surfaces.

The female connector 40 includes a rectangular insulating housing 45. The insulating housing 45 defines a recess 46 in a rear surface of the insulating housing 45. A plurality of terminals 44 is assembled in the recess 46. An anti-mistake insertion gap 410 communicating with the recess 46 is defined in a top 41 of the insulating housing 45, to engage with the tab 310 of the male connector 30. Two fastening holes 46 are defined in the top 41, at opposite sides of the insertion gap 410, respectively. An elastic tab 461 extends down from a sidewall bounding each fastening hole 46 adjacent to the rear surface of the insulating housing 45. Two isolating slots 462 (labeled in FIG. 4) are defined in the top 41 at two opposite sides of the elastic tab 461 and communicating with the fastening hole 46. Two grooves 420 are defined in left and right end surfaces 42 of the insulating housing 45, respectively. The grooves 420 extend through the rear surface of the insulating housing 45.

Figure 3:
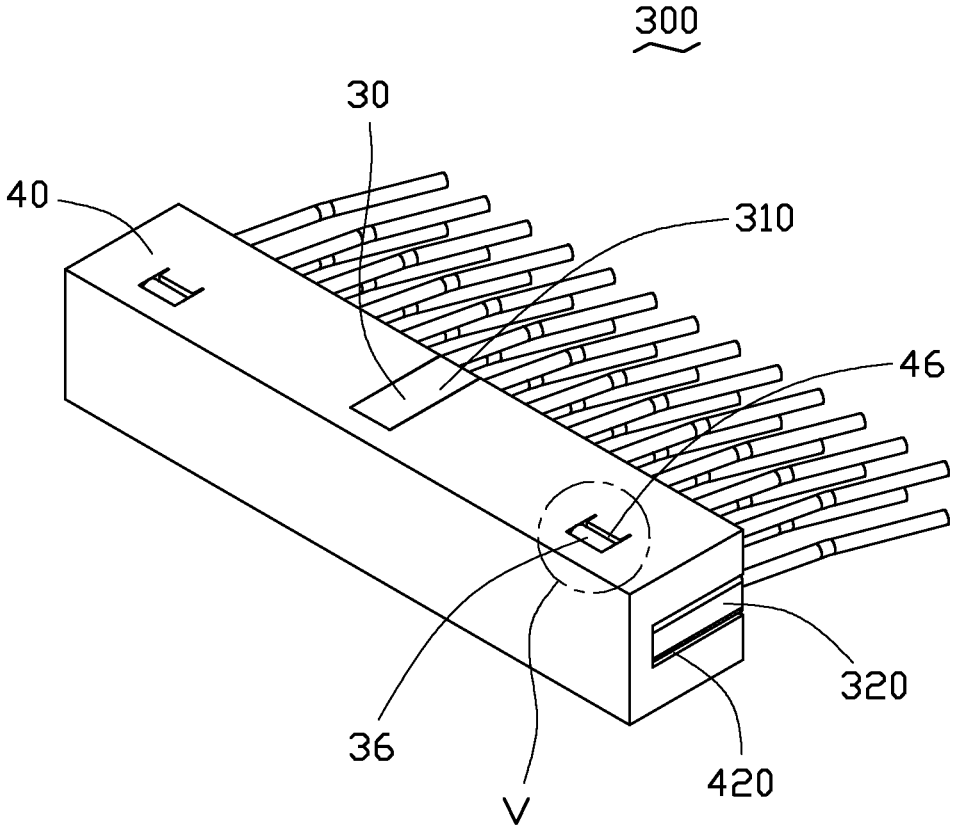
FIG. 3 is an assembled, isometric view of FIG. 1.
Figure 4:
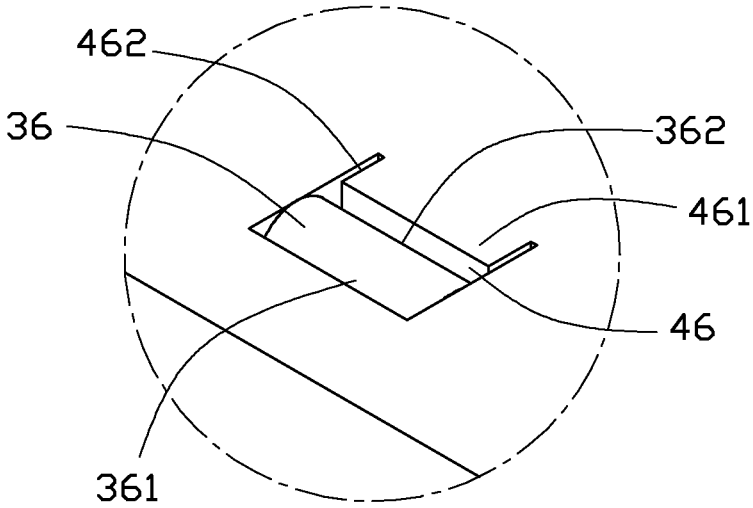
FIG. 4 is an enlarged view of a circled portion V of FIG. 3.

Referring to FIG. 3 and FIG. 4, in assembly, the insulating housing 35 of the male connector 30 is inserted into the recess 46 of the female connector 40. The blocks 320 enter the corresponding grooves 420, and the tab 310 enters the gap 410. The protrusions 36 enter the recess 46 to slightly deform the top 41 and the elastic tabs 461 up through the insertion surfaces 361 resisting against the elastic tabs 461. After the protrusions 36 enter the fastening holes 46, the top 41 and the elastic tabs 461 are restored, thereby holding the protrusions 36 in the fastening holes 46. The male connector 30 is then fastened to the female connector 40. The terminals 37 are connected to the terminals 44.

In disassembly, the protrusion 36 are operated to disengage from the fastening holes 46. The ejecting surfaces 362 resist against the elastic tabs 461, to deform the elastic tabs 461 and the top 41 up. Because of the elastic tabs 461 and the ejecting surfaces 362, the force acted on the male connector 30 increases gradually, thus the male connector 30 can be moved away from the recess 46 of the female connector 40 easily. The blocks 320 also disengage from the corresponding grooves 420.

It is to be understood, however, that even though numerous characteristics and advantages of the present disclosure have been set forth in the foregoing description, together with details of the structure and function of the disclosure, the disclosure is illustrative only, and changes may be made in details, especially in matters of shape, size, and arrangement of parts within the principles of the disclosure to the full extent indicated by the broad general meaning of the terms in which the appended claims are expressed.

What is claimed is:

1. An electrical connector assembly, comprising:

a male connector comprising a male insulating housing and a plurality of first terminals assembled to the male insulating housing, a protrusion extending up from the top surface of the male insulating housing, the protrusion forming an ejecting surface on a rear side of the protrusion; and a female connector comprising a female insulating housing which defines a recess for accommodating the male insulating housing, and a plurality of second terminals, assembled in the recess, to connect to the first terminals, the top surface of the female insulating housing defining a fastening hole communicating with the recess, and an elastic tab extending downward from a rear sidewall of the fastening hole to hold the protrusion against a front sidewall of the fastening hole in the fastening hole;

wherein the ejecting surface of the protrusion is substantially arc-shaped or inclined;

wherein two isolating slots are defined in the top surface of the female connector, at two opposite sides of the elastic tab and communicating with the fastening hole; and wherein the elastic tab abuts against the ejecting surface when disassembling the male connector from the female connector.

2. The electrical connector assembly of claim 1, wherein the protrusion is substantially semi-cylindrical or triangular.

3. The electrical connector assembly of claim 1, wherein the protrusion further forms an insertion surface on a front side of the protrusion.

4. The electrical connector assembly of claim 3, wherein the insertion surface is substantially arc-shaped or inclined.

5. The electrical connector assembly of claim 1, wherein two blocks extend from opposite end surfaces of the male insulating housing, and two grooves are defined in opposite end surfaces of the female insulating housing to respectively hold the two blocks.

6. The electrical connector assembly of claim 1, wherein an anti-mistake insertion tab extends from the top of the male insulating housing, and an anti-mistake insertion gap is defined on the top of the female insulating housing to hold the anti-mistake insertion tab.

7. An electrical connector assembly, comprising:

a male connector comprising a male insulating housing and a plurality of first terminals assembled to the male insulating housing, a protrusion extending up from the top surface of the male insulating housing, the protrusion forming an insertion surface on a front side of the protrusion; and a female connector comprising a female insulating housing which defines a recess for accommodating the male insulating housing, and a plurality of second terminals, assembled in the recess, to connect to the first terminals, the top surface of the female insulating housing defining a fastening hole communicating with the recess, and an elastic tab extending downward from a rear sidewall of the fastening hole to hold the protrusion together with a front sidewall of the fastening hole in the fastening hole;

wherein the insertion surface of the protrusion is substantially arc-shaped or inclined;

wherein two isolating slots are defined in the to surface of the female connector, at two opposite sides of the elastic tab and communicating with the fastening hole; and wherein the elastic tab abuts against the insertion surface when assembling the male connector to the female connector.

8. The electrical connector assembly of claim 7, wherein the protrusion is substantially semi-cylindrical or triangular.

9. The electrical connector assembly of claim 7, wherein two blocks extend from opposite end surfaces of the male insulating housing, and two grooves are defined in opposite end surfaces of the female insulating housing to respectively hold the two blocks.

10. The electrical connector assembly of claim 7, wherein an anti-mistake insertion tab extends from the top of the male insulating housing, and an anti-mistake insertion gap is defined on the top of the female insulating housing to hold the anti-mistake insertion tab.

* * * * *